United States Patent [19]

Nagasaka et al.

[11] Patent Number: 4,805,069

[45] Date of Patent: Feb. 14, 1989

[54] POWDER CHARGING APPARATUS AND ELECTROSTATIC POWDER PAINTING APPARATUS

[75] Inventors: Hideo Nagasaka, Hitachi; Masahiro Yamamoto, Sakura; Tadao Morita, Chiba; Hiroshi Saitoh, Funabashi; Tsutomu Itoh, Tokyo, all of Japan

[73] Assignee: Onada Cement Co., Ltd., Onada, Japan

[21] Appl. No.: 22,765

[22] Filed: Mar. 6, 1987

[30] Foreign Application Priority Data

Mar. 10, 1986 [JP] Japan ..... 61-51663

[51] Int. Cl.[4] ..... B05B 5/02

[52] U.S. Cl. ..... 361/226; 361/227; 361/230

[58] Field of Search ..... 361/226–227, 361/229, 330, 235; 239/690–708

[56] References Cited

U.S. PATENT DOCUMENTS 4,020,393 4/1977 Porter ..... 239/707 X
4,135,667 1/1979 Benedek et al. ..... 239/697
4,210,949 7/1981 Masuda ..... 361/226
4,289,278 9/1981 Itoh ..... 361/227
4,414,603 11/1983 Masuda ..... 361/227

*Primary Examiner*—L. T. Hix
*Assistant Examiner*—D. Rutledge
*Attorney, Agent, or Firm*—Price, Heneveld, Cooper, DeWitt & Litton

[57] ABSTRACT

A powder charging apparatus, in which a plasma electrode pair is disposed within an insulative tubular passage for transporting powder as carried by gas, a device for intermittently applying a D.C. voltage between that pair of plasma electrode is provided to form a space where mainly desired polarity ions drawn from the plasma electrode pair exist and another space where mainly opposite polarity ions exist, well dispersed powder is fed to the former space where mainly the desired polarity ions exist, and thereby stable and strong charging performances can be assured for a long term without adhesion and accumulation of the powder to and on either one of the pair of plasma electrodes; and an electrostatic powder painting apparatus containing this powder charging apparatus therein and having excellent penetrating performance and painting efficiency.

39 Claims, 12 Drawing Sheets

POWDER CHARGING APPARATUS AND ELECTROSTATIC POWDER PAINTING APPARATUS

BACKGROUND OF THE INVENTION

The present invention relates to a powder charging apparatus for charging powder paint that is necessitated when electrostatic powder painting is effected, and an electrostatic powder painting apparatus for applying powder paint charged by the powder charging apparatus to an article to be painted.

Heretofore, in such type of powder charging apparatus and in an electrostatic powder painting apparatus provided with th e powder charging apparatus, firstly, a ring-shaped electrode is provided on an inner peripheral surface of a tubular passage for conveying powder paint or the like as carried by gas, a tip end of a corona discharge electrode is disposed on the axis of the above-mentioned ring-shaped electrode to make an ionic current flow continuously from the corona discharge electrode towards the inner peripheral surface of the ring-shaped electrode, and powder flowing through the tubular passage simultaneously therewith is charged upon traversing the ionic current.

In addition, secondly, a ring-shaped slit is provided at an upstream end portion of the inner peripheral surface of the ring-shaped electrode, the opening of the slit is directed to the downstream side so that the inner peripheral surface of the ring-shaped electrode may be rubbed by clean gas ejected therefrom at a highvelocity, and thereby the inner peripheral surface can be always kept clean.

Furthermore, thirdly, the configuration of the ring-shaped shaped electrode in each of the above-described apparatuses is chosen to form a cup-shaped cylindrical electrode diverging towards the downstream, and also at the downstream end of the inner peripheral surface of the cylindrical electrode is disposed a ring-shaped slit with its opening directed towards the upstream side.

As described above, in the first and second apparatuses in the prior art, when the powder flowing through the tubular passage traverses the radial ionic current, the powder is charged, but since this powder flowing through the tubular passage is apt to flow as deviated to one side of the inner peripheral surface of the tubular passage generally due to influences of the gravity and bending of pipings connected to the upstream, and moreover since the above-mentioned radial ionic current would have its ionic current density reduced as the position approaches from the axis to the inner peripheral surface and the powder paint would traverse the portion where the ionic current density is low, one cannot expect a high charging efficiency.

In addition, since clean air is ejected at a high velocity from the ring-shaped slit towards the downstream side, the velocity of the powder flowing through the tubular passage is increased, hense a stay time in the charging region becomes short, and the charging efficiency would be lowered. Also, when this charging apparatus is used in a spray gun of an electrostatic powder painting apparatus, the velocity of the spraying material ejected from the tip end of the gun becomes large, and so, there is a fear that a painting efficiency for an article to be painted may be lowered.

The third one of the techniques in the prior art is such that it is avoided for powder paint to pass through a region where an ionic current density is low, but the powder paint is made to traverse a region where the density is high, and thereby a charging efficiency is improved. Furthermore, the powder flowing through the tubular passage is decelerated by clean air at a high velocity that is ejected from a ring-shaped slit to thereby also improve the charging efficiency, and it is contemplated that when this charging apparatus is used in a spray gun of an electrostatic powder painting apparatus, the velocity of powder ejected from the tip end of the gun is not increased and thereby the painting efficiency of the powder paint to an article to be painted is enhanced. In this case, the clean air ejected at a high speed from the opening of the ring-shaped slit would flow along a cup-shaped inner surface of a cylindrical electrode from a large diameter portion towards a small diameter portion, because the opening is directed towards the upstream side. Thereafter, it collides and joints with powder material flowing through a tubular passage communicated with the small diameter portion towards the downstream, and subsequently flows as traversing an ionic current which flows radially from the corona discharge electrode towards the inner surface of the cylindrical electrode. At this time, since the clean air flowing along the inner surface of the cup-shaped electrode has its flow direction varied gradually from the upstream direction to the direction directed to the axis of the tubular passage as it moves from the large diameter portion to the small diameter portion, the flow of this clean air would guide the powder flowing through the tubular passage towards the downstream so as to make the powder approach from the inner periphery of the tubular passage to its axis. At this moment, since the above-mentioned clean air collides with the powder being conveyed and quickly stirs the powder, the powder can be well dispersed, and furthermore, due to the effect of the velocity component possessed by the clean air that is opposite in direction to the velocity of the conveying air, the powder is decelerated, so that the period when the powder stays in the region where the corona discharge is generated becomes long.

As a result, the powder flowing through the tubular passage is narrowed towards the axis of the tubular passage, hence the powder would traverse the central portion of the radial ionic current in a narrowed state, and it is charged while passing through the region of the radial ionic current where the current density is highest and the electric field strength is strongest.

The common point of the above-described techniques in the past is characterized in that according to anyone of the techniques, a normal operation is such that plasma is generated by only the corona electrode, a mono-polar ionic current drawn from the plasma flows continuously towards a ring-shaped electrode or a cylindrical electrode, and under this condition, powder to be charged is passed through the space intervening the respective electrodes.

Problems which are common to these techniques in the past, are that in the case of processing powder having a high specific resistance and a strong adhesiveness, as an operating time elapses the powder adheres to and accumulates on the surface of the ring-shaped electrode or the cylindrical electrode, due to back corona discharge generated here a large ionic current of the opposite polarity would flow towards the corona discharge electrode, thereby the charge accumulated by the corona discharge current would be neutralized, and charging of the powder becomes unstable and eventually impossible.

SUMMARY OF THE INVENTION

It is therefore one object of the present invention to resolve the above-mentioned problems in the prior art.

Another object of the present invention is to further improve a charging rate of powder as compared to the case where powder is charged by a continuous ionic current as described above.

According to one feature of the present invention, there are provided means for enhancing charging capability of an ionic current of desired polarity larger than charging capability of an ionic current of the opposite polarity through the procedure that in place of the electrode pair consisting of a corona discharge electrode and a ring electrode or consisting of a corona discharge electrode and a cylindrical electrode in the abovementioned respective apparatuses, a high voltage is intermittently applied between an electrode pair consisting of a plasma electrode of desired polarity and another plasma electrode of the opposite polarity, and eventually well dispersed powder is made to pass through and ejected from a space, in which among two kinds of positive and negative ionic currents drawn from plasmas produced respectively at the tip ends of the respective plasma electrodes, only the ionic current having the polarity with which its is desired to charge the powder (hereinafter called simply "desired polarity") exists, further if necessary, means for keeping the powder remote from the space in which the ions of the opposite polarity exist, and means for preventing the powder from adhering to the plasma electrodes, and depending upon the object of use, either one of the corona discharge electrodes is connected to the ground.

Owing to the effects of the centrifugal repulsion caused by an ionic current, an electric wind, a D.C. repulsion and an uneven alternating electric field emanating from the electrodes as an action of the plasma and the uneven electric field generated intermittently at the tip ends of the respective plasma electrodes, the plasma electrodes have the effect of charging and repelling the powder particles existing in the proximity of the electrodes continuously during operation, so that the powder particles would not adhere to nor accumulate on either electrode, hence performance of the electrodes would not change, and operation can be achieved stably for a long period. The addition of the means for preventing the powder from adhering to the corona discharge electrode is mainly for the purpose of preventing adhesion of the powder under a transient condition for starting or stopping. In this apparatus, simultaneously with an ionic current of desired polarity, an ionic current of the opposite polarity always exists. The means for keeping the powder remote from the region where an ionic current of the opposite polarity exists, and/or to make the voltage-current characteristic of the corona discharge electrode of the opposite polarity smaller than the voltage-current characteristic of the corona discharge electrode of the desired polarity by as much as possible, are for the purpose of reducing the neutralization of electric charge by means of the ionic current of the opposite polarity and thereby making the eventual amount of charge resulting as a difference between these positive and negative charges sufficiently large in practical use.

According to the present invention, since powder particles are introduced into the space where the ionic current of desired polarity exists in a well dispersed condition, charging is effected at a high efficiency.

In the case where the powder charging apparatus according to the present invention is mounted in a tubular passage, if a plasma electrode of desired polarity is placed on the downstream side of the tubular passage made of insulating material and a plasma electrode of the opposite polarity is placed on the upstream side, then powder material charged with the desired polarity can be given at the outlet of the tubular passage.

If plasma electrode of desired polarity is disposed in the proximity of an outlet on the downstream side of a tubular passage made of insulating material and is grounded and a plasma electrode of the opposite polarity is disposed on the upstream side, then charged powder particles can be obtained without an external electric field, and by spraying these charged particles to an article to be painted, electrostatic powder painting having an excellent penetrating performance can be achieved.

If a plasma electrode of desired polarity is disposed in the proximity of an outlet on the downstream side of a tubular passage made of insulating material and a plasma electrode of the opposite polarity is disposed on the upstream side and is grounded, then charged powder can be sprayed to an article to be painted under a condition where an external ionic current is not present, although an external electric field is present, and thereby electrostatic powder painting of a thick film can be achieved.

By disposing a plasma electrode of desired polarity in the proximity of an outlet end of a tubular passage made of insulating material so as to be opposed to and separated from an article to be painted, further applying a high voltage to that plasma electrode so that an ionic current flowing from the plasma electrode of the desired polarity to the exterior may exist, disposing a corona discharge electrode of the opposite polarity on the upstream side and connecting it to the ground, the powder charged within the charging apparatus can be further charged under existence of the external electric field and the external ionic current, and thus electrostatic powder painting can be achieved. Therefore, electrostatic powder painting having very excellent painting efficiency and back painting property can be practiced.

DESCRIPTION OF THE PREFERRED EMBODIMENTS

Figure 1:
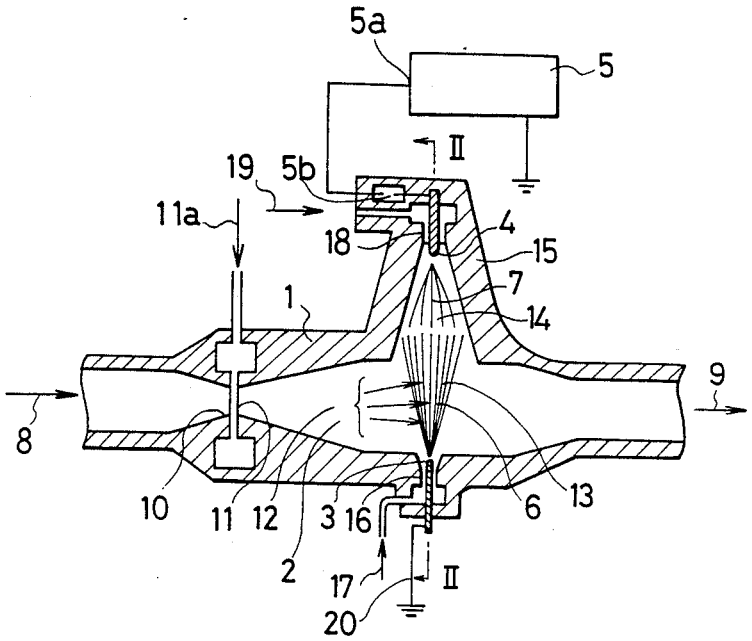
FIG. 1 is a longitudinal cross-section view of a powder charging apparatus according to the present invention.
Figure 2:
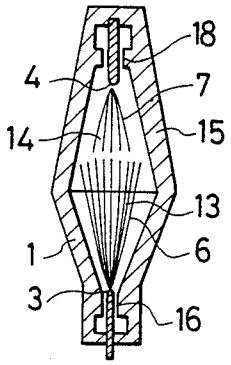
FIG. 2 is a cross-section view taken along line II—II in FIG. 1 as viewed in the direction of arrows.

In the preferred embodiment of the present invention illustrated in FIGS. 1 and 2, a desired polarity plasma electrode 3 is a needle electrode having a small radius of curvature at its tip end and forms a low voltage side plasma electrode, whereas an opposite polarity plasma electrode 4 is a needle electrode having a large radius of curvature at its tip end and forms a high voltage side plasma electrode, and between these two electrodes is intermittently applied a high voltage of 20,000–80,000 volts from a D.C. voltage surface 5 through a discharge gap 5b. As a result, between the respective electrodes is intermittently generated bipolar corona discharge as shown in FIG. 1, and at the tip ends of the respective electrodes is respectively formed plasma. In this instance, since the radius of curvature at the tip end of the desired polarity plasma electrode 3 is small, a desired polarity ionic current 6 drawn from this electrode is large as compared to an opposite polarity ionic current 7 drawn from the opposite polarity plasma electrode 4, and also is present over a long broad region. Accordingly, powder carried by gas indicated by an arrow 8 is stirred by a choke 10 and a dispersing gas 11a ejected from a dispersing gas jet 11 provided at this chock and becomes well dispersed powder 12, and then it is charged while passing through a space 13 where mainly desired polarity ions exist and becomes charged powder 9.

In this case, as will be apparent from FIG. 1, since a space 14 where mainly opposite polarity ions exist is substantially separated from the tubular passage 2 by means 14 for keeping the powder remote from this space, it scarcely occurs that the electric charge produced by the desired polarity ionic current is neutralized by the opposite polarity ionic current 7, and furthermore, this is further assured by an adhesion preventing gas 19 fed through an opposite polarity plasma electrode gas jet port 18 around the opposite polarity plasma electrode. In the powder charging apparatus according to the present invention, since the used electrodes are both corona discharge electrodes having plasma formed at their tip ends, owing to the effects of ionic currents, electric winds, D.C. repulsions, etc. issued from the electrodes by the actions of the plasmas and the electric fields generated at the tip ends of the respective corona discharge electrodes, the plasma electrodes have the effects of charging the particles existing in the proximity of the electrode and ejecting them, so that powder particles would not adhere to and accumulate on the electrodes always during operation, performances of the electrodes would not change and operation can be continued stably for a long period of time. It is to be noted that around the desired polarity plasma electrode 3 is also provided a desired polarity plasma electrode gas jet port 16 in a ring shape, and through this gas jet 16 an adhesion preventing gas 17 is blown in at a high velocity. The adhesion preventing gases 17 and 19 are for the purpose of preventing adhesion of powder to the tip ends of the electrodes under a transient condition mainly upon starting and stopping of operation of a torch.

Since an output terminal **5*a* of the D.C. voltage source 5 and the opposite polarity plasma electrode 4 are connected via a discharge gap 5*b*, the opposite polarity electrode 4 is fed with a voltage from the D.C. voltage source 5 via the discharge gap 5*b*, and while the voltage is increasing as the feeding time elapses, when the voltage has become a high voltage between that electrode 4 and the desired polarity plasma electrode 3 are momentarily generated the opposite polarity ionic current 7 and the desire polarity ionic current 6, hence the voltage of the opposite polarity plasma electrode 4 is lowered abruptly, and the above-mentioned respective ionic currents 6 and 7** would cease.

If the currents cease, the voltage of the opposite polarity plasma electrode 4 is again raised by the voltage of the D.C. voltage source 5 fed through the discharge gap **5*b***, and the above-described operation is repeated. The repetition is effected normally at a frequency of 5KC–50KC.

In this way, the respective ionic currents 13 and 14 flow intermittently, and by varying the relative velocity between the ion particles and the powder particles at that time, a charging rate can be enhanced.

It is to be noted that if a powder charging apparatus according to the present invention of the type shown in FIG. 1 and having a large capacity is necessitated, the object can be achieved by providing the electrode pair in multiple along the direction of flow in the tubular passage.

Figure 3:
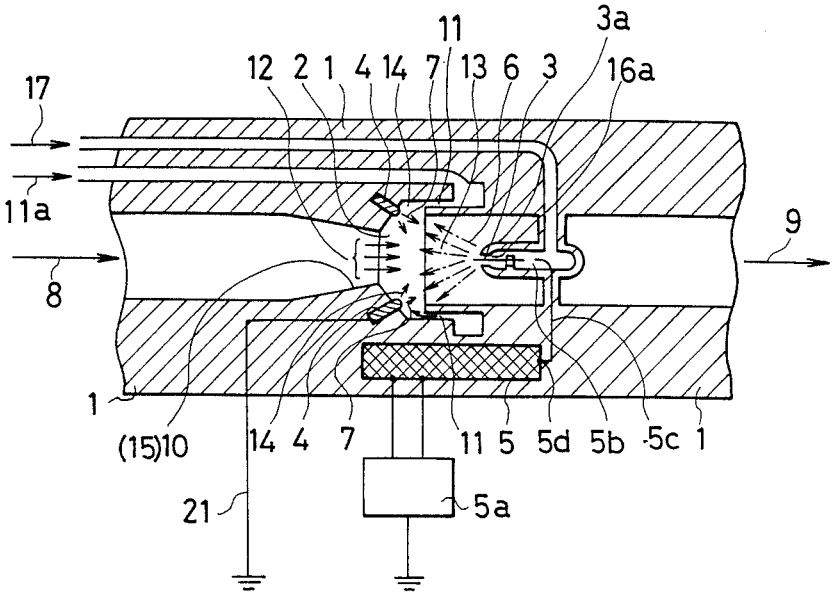
FIGS. 3, 4, 5 and 6, respectively, are longitudinal cross-section views of other preferred embodiments of the present invention.

In another preferred embodiment shown in FIG. 3, on the inside of a cylindrical body 1 made of insulating material whose cross-section configuration is circular, is formed a tubular passage 2 for transporting powder 8 carried by gas, on the axis of this tubular passage 2 is disposed a thin corona discharge electrode so as to operate as a desired polarity plasma electrode 3, and a thick corona discharge electrode opposed to that plasma electrode 3 is provided on an outer peripheral surface of the tubular passage 2 so as to operate as an opposite polarity plasma electrode 4. In this instance, the inner surface of the tubular passage 2 where the opposite polarity plasma electrode 4 is disposed form a surface converging toward the upstream which is contiguous to a choke 10 at the upstream, also at the downstream of that inner surface, a dispersing gas indicated by an arrow 11a is ejected from a ring-shaped dispersing gas jet port 11 to keep the tip end of the opposite polarity plasma electrode 4 always clean, hence well dispersed powder 12 is produced by the effect that the dispersing gas traverses the tubular passage 2 to stir and disperse the powder and is blown towards a space 13 where mainly a desired polarity ionic current 6 drawn from the tip end of the desired polarity plasma electrode 3 exists, and thereby the powder can be charged. In this case, since the opposite polarity ionic current 7 drawn from the opposite polarity plasma electrode 4 is in itself small because of the large radius of curvature at the tip end of the electrode 4 and the construction is such that the powder may be brought remote from the space 7 where mainly the opposite polarity ions exist due to the chock 10, neutralization of the charge of the desired polarity by the opposite polarity ions can be suppressed small, and after all, a charging efficiency can be made high as a whole. In this embodiment, reference numeral 5 designates a D.C. voltage source for applying D.C. voltages to the respective electrodes, one end of a lead wire **5*c* is connected to an output terminal 5*d* of the D.C. voltage source 5, and the other end thereof is opposed to the desired polarity plasma electrode 3 via a discharge gap 5*b* of 1–5 mm. Reference numeral 5*a* designates a high frequency voltage source for supplying electric power to that electrode. It is to be noted that the desired polarity plasma electrode 3 operates as a high voltage side plasma electrode and is disposed within a protective tube 3***a*, and an adhesion preventing gas 17 ejected at a high velocity from a high voltage side plasma electrode gas jet port 16*a* at the tip end of the protective tube 3*a*, serves to prevent discharge produces produced in the discharge gap 5*b* and the powder from adhering to the tip end of the desired polarity plasma discharge electrode 3, which would occur mainly under a transient condition upon starting or stopping.

Figure 4:
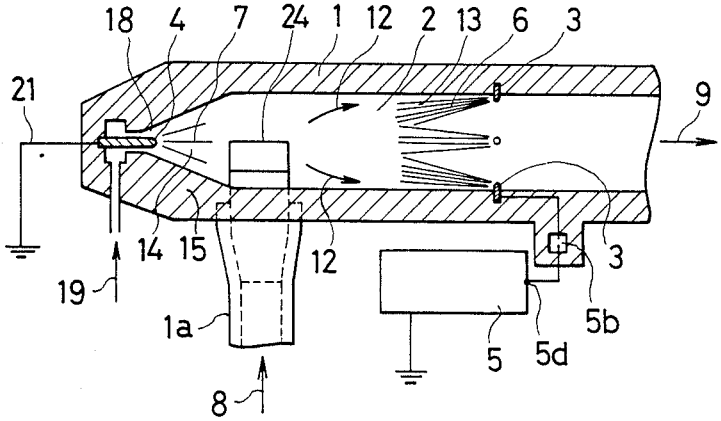

FIG. 4 shows another preferred embodiment, in which a desired polarity plasma electrode 3 is provided on an inner surface of a tubular passage 2 formed by a cylindrical body 1. In this embodiment, powder 8 carried by gas is introduced from a tangential direction of the tubular passage 2 to the upstream side of the desired polarity plasma electrode 3 by means of a powder introducing tubular passage 1*a*, and an adhesion preventing gas 19 is supplied through an opposite polarity plasma electrode gas jet port 18 formed around an opposite polarity plasma electrode 4. Thus, by a D.C. high voltage applied intermittently between the grounded opposite polarity plasma electrode 4 and the desired polarity plasma electrode 3 from a voltage source 5 via a discharge gap 5*b*, corona discharge is generated intermittently between the respective electrodes, and as shown in FIG. 3, a desired polarity ionic current 6 drawn from the desired polarity plasma electrode 3 forms a space 13 along the tube wall where mainly desired polarity ions exist. In this case, the powder introduced into the tubular passage 2 through a powder introducing side port 24 would turn round at a high velocity in the tubular passage 2 and would become well dispersed powder 12 along the tube wall, then it flows out as traversing the space 13 where mainly the desired polarity ions exist, and therefore, well charged powder 9 can be obtained. In this case, since the powder 8 would not enter the space 14 where mainly an opposite polarity ionic current 7 exists as assisted by the action of the adhesion preventing gas 19, neutralization by the opposite polarity ionic current 7 of the charge given by the desired polarity ionic current 6 can be suppressed to a very small amount. In this embodiment, while an adhesion preventing gas could be blown towards the desired polarity plasma electrode 3 if necessary, in many cases the powder can be prevented from adhering to the desired polarity plasma electrode 3 by a strong turning flow itself with the illustrated construction.

Figure 5:
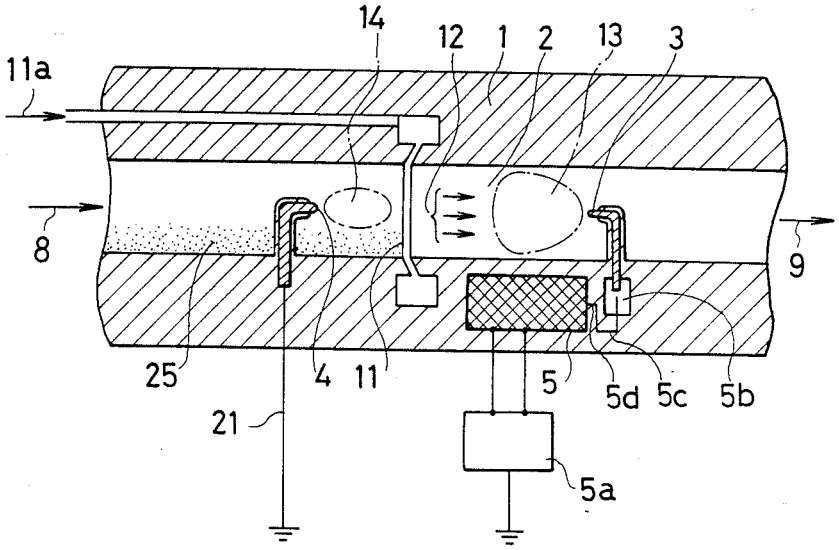

FIG. 5 shows still another preferred embodiment of the present invention, in which on the inside of a cylindrical body 1 whose cross-section configuration is circular, is formed a tubular passage 2 for transporting powder 8 carried by gas, a desired polarity plasma electrode 3 consisting of a needle electrode having a small radius of curvature at its tip end is disposed on the axis of the tubular passage 2, also an opposite polarity plasma electrode 4 having a large radius of curvature at its tip end is disposed on the same axis as opposed to the desired polarity plasma electrode 3, and between these two plasma electrodes is intermittently applied a D.C. high voltage from a high frequency voltage source 5*a* through a multi-stage voltage step-up circuit 5 and a discharge gap 5*b*. In addition, at a location a little shifted from the middle of the respective electrodes towards the upstream side is provided a ringshaped dispersing gas jet port 11, and a dispersing gas 11*a* is blown into the tubular passage 2 through this jet port. Normally, in a powder charging apparatus of the class required for electrostatic powder painting or the like, in many cases transportation of powder through a tubular passage is not effected at so high velocity, and in such cases the powder carried by gas form a deviated flow as shown at 25, hence even if the powder flow should pass through a space 14 where mainly opposite polarity ions exist which space is formed in the proximity of the tip end of the opposite polarity plasma electrode 4, in most cases the powder would not be charged so much in substance. Accordingly, by making a dispersing gas 11a spout strongly from a dispersing gas jet port 11 just behind this space 14 and making well dispersed powder 12 pass through a space 13 where mainly desired polarity ions exist, charging by only the desired polarity ions can be practiced while substantially avoiding neutralization by the opposite polarity ions, and thereby charged powder 9 can be obtained stably for a long period of time. Although positive means for bringing powder remote from the space where the opposite polarity ions exist is provided in other preferred embodiments (FIGS. 1, 4, 6 and 8) of the present invention, the embodiment shown in FIG. 5 can be deemed to include means for bringing powder remote from a space where opposite polarity ions exist according to the present invention in certain means, as will be seen from the above description.

Figure 6:
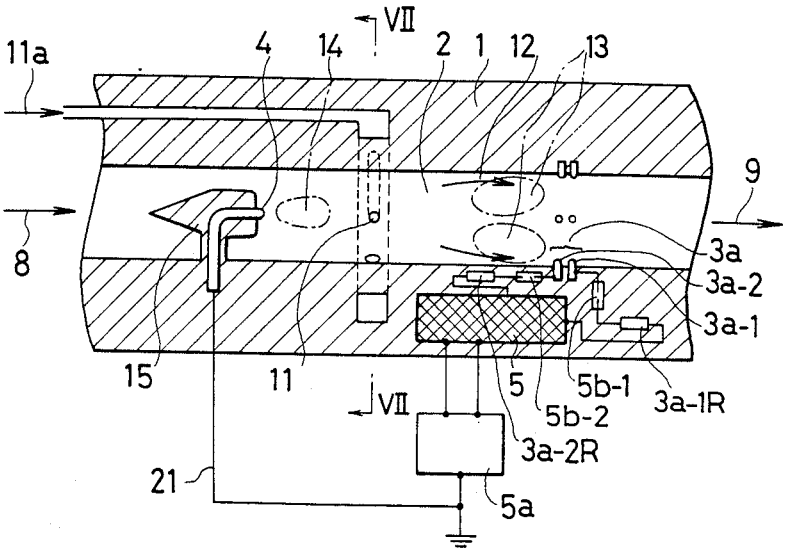
Figure 7:
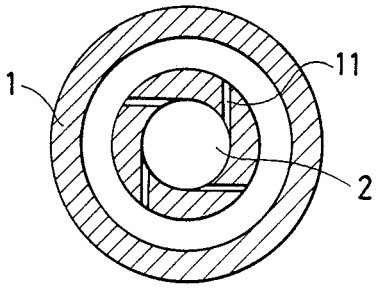
FIG. 7 is a cross-section view taken along line VII—VII in FIG. 6 as viewed in the direction of arrows.

In yet another preferred embodiment of the present invention shown in FIGS. 6 and 7, on the inside of a cylindrical body 1 having a circular cross-section configuration and made of insulating material is formed a tubular passage 2 for transporting powder 8 carried by gas, along the axis on the upstream side of the inner surface of that tubular passage 2 is disposed on opposite polarity plasma electrode 4 consisting of a needle electrode having a large radius of convature at its tip end, conical means 15 for bringing the powder remote from the electrode 4 is disposed just upstream of the electrode 4, and a desired polarity plasma electrode assembly 3*a* is disposed as opposed to the conical means 15. The desired polarity plasma electrode assembly 3*a* in this preferred embodiment is composed of two electrodes 3*a*-1 and 3*a*-2 disposed close to each other, which are applied with high voltages of different magnitudes from different positions of a D.C. voltage source 5 contained in the cylindrical body 1 through a protective resistor 3*a*-1R and a discharge gap 5*b*-1, and a protective resistor 3*a*-2R and a discharge gap 5*b*-2, respectively, hence plasma induced by minute spark discharge is formed between the respective electrodes 3*a*-1 and 3*a*-2, and thereby a desired magnitude ionic current of sufficient magnitude is drawn intermittently towards the opposite polarity plasma electrode 4, so that a space 13 where mainly desired polarity ions exist can be formed. It is to be noted that reference numeral 5*a* designates a high frequency voltage source for supplying electric power to the D.C. voltage source. In the middle between these desired polarity plasma electrode and opposite polarity plasma electrode are formed a plurality of turning flow jet ports 11 opening in the tubular passage 2, a dispersing gas 11*a* is fed through these jet ports 11, and after the powder 8 existing within the tubular passage 2 has been well stirred and dispersed by the dispersing gas 11*a*, the powder comes close to the tube wall and passes through the space 13 where mainly the desired polarity ions exist, and monopolarly charged powder 9 can be obtained. In this embodiment, owing to the actions of both the means 15 for bringing the powder 8 remote from the opposite polarity plasma electrode 4 and the turning flow jet port 11 which serves as a dispersing gas jet port, and powder would scarcely come close to a space 14 where mainly opposite polarity ions exist, so that neutralization of charge caused by the opposite polarity ions can be substantially avoided, and thereby stable charging of powder can be practiced at a high efficiency for a long period of time. It is to be noted that either one of the above-described discharge gaps **5*b*-1 and 5*b*-2** can be omitted without any inconvenience.

Figure 8:
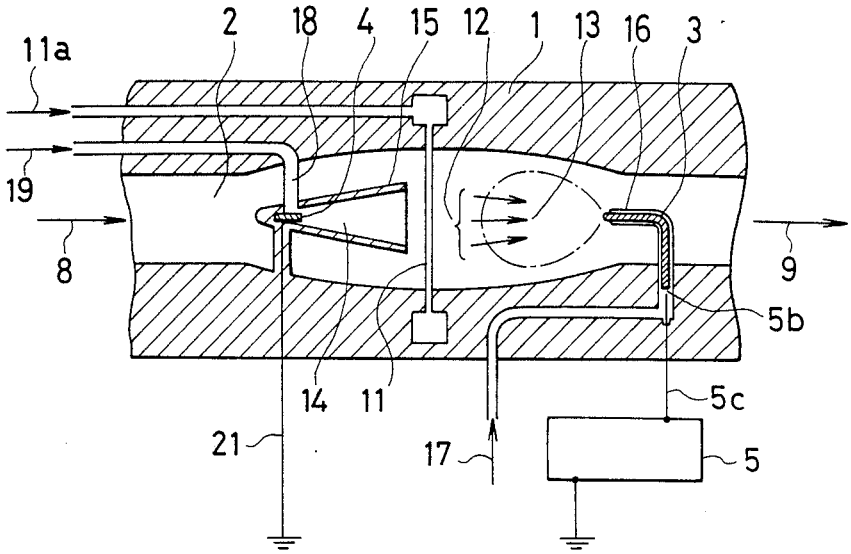
FIGS. 8, 9, 10, 11 and 12, respectively, are longitudinal cross-section views of still other preferred embodiments of the present invention.

In a further preferred embodiment shown in FIG. 8, on the inside of a cylindrical body 1 made of insulating material and having a circular cross-section configuration is formed a tubular passage 2 for transporting powder 8 carried by gas, a desired polarity plasma electrode consisting of a needle electrode having a small radius of curveture at its tip end is disposed on the outlet side of the axis of the tubular passage 2, a high voltage fed from a D.C. voltage source 5 is intermittently applied to this plasma electrode 3 through a discharge gap **5*b*, an adhesion preventing gas 17 is ejected from a desired polarity plasma electrode gas jet port 16 formed around the plasma electrode 3, an opposite polarity plasma electrode 4 consisting of a needle electrode 4 having a large radius of curvature at its tip end is disposed as opposed to the plasma electrode 3, around the plasma electrode 4 is disposed a hollow conical body 15 serving as means for bringing powder remote from the opposite polarity plasma electrode 4, and arrangement is done such that an adhesion preventing gas 19 may be blown from the periphery of the opposite polarity plasma electrode 4 through an opposite polarity plasma electrode gas jet port 18**.

In this preferred embodiment, since the powder would pass through the region around the opposite polarity plasma electrode 4 without entering a space 14 where mainly opposite polarity ions exist, and since thereafter the powder is introduced into a space 13 where mainly desired polarity ion exist while being gathered to the central region of the tubular passage 2 under the condition where the powder has been well dispersed by a dispersing gas **11*a* ejected from a ring-shaped gas jet port 11, charging of powder can be practiced at a high efficiency, substantially without neutralization of charge caused by the opposite polarity plasma electrode 4, and well charged powder 9** can be obtained.

In the powder charging apparatus according to the present invention, generally a high efficiency can be easily obtained if a voltage-current characteristic of a desired polarity plasma electrode is chose larger than a voltage-current characteristic of an opposite polarity plasma electrode. However, in the case where means for bringing powder remote from a space 14, in which mainly opposite polarity ions exist, is provided as in the case with FIGS. 1, 3, 4, 5, 6 and 8, in some cases it is not always necessary to make the voltage-current characteristics of the respective plasma electrodes different.

Figure 9:
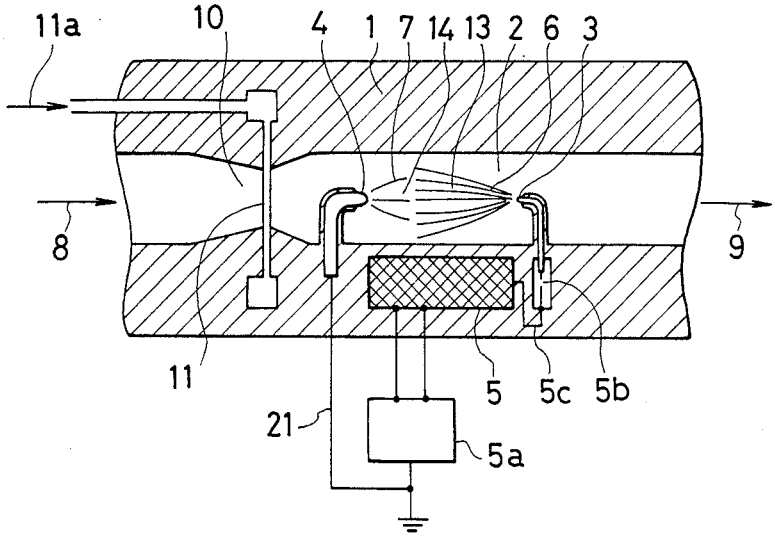

FIG. 9 shows a still further preferred embodiment of the present invention, in which charging of powder is practiced relying upon a principal effect of the fact that a large difference is maintained between voltage-current characteristics in an operating state of a desired polarity plasma electrode 3 and an opposite polarity plasma electrode 4 according to the present invention. In FIG. 9, on the inside of a cylindrical body 1 made of insulating material and having a circular cross-section configuration is formed a tubular passage 2 for transporting powder 8 carried by gas, a desired polarity plasma electrode 3 having an extremely small radius of curvature at its tip end and having good durability is disposed on the axis of the tubular passage 2, an opposite polarity plasma electrode 4 having a large radius of curvature at its tip end is disposed as opposed to the former plasma electrode 3 and is grounded, also a high voltage is intermittently applied to the desired polarity plasma electrode 3 from a D.C. voltage source 5 via a discharge gap **5*b*, further a dispersing gas 11*a* is ejected from a ring-shaped dispersing gas jet port 11 provided in the region of a choke 10 formed at the upstream of the opposite polarity plasma electrode 4 to feed the powder to the plasma electrodes in a well dispersed condition, and then the powder is made to pass through the desired polarity plasma electrode region, it is to be noted that reference numeral 5*a* designates a high frequency voltage source for feeding electric power to the D.C. high voltage circuit 5. With the above-mentioned provision, the powder carried by gas is already in a well dispersed state and is liable to be charged, and since it passes, at first, through a space 14 where mainly opposite polarity ions exist that is formed downstream of the opposite polarity plasma electrode 4, it is once charged in the opposite polarity, but as it subsequently passes through a space 13 where a strong desired polarity ionic current drawn from the desired polarity plasma electrode 3 having a sufficiently large voltage-current characteristic exists, the previously given charge is offset here, and after the powder has been charged sufficiently in the desired polarity it is ejected as shown by an arrow 9**. In order to achieve such object, it is necessary to give a large difference between the charging characteristics of the respective electrodes, and although in some cases selection of a flow rate and polarity of the powder to be processed may be limited, the structure is extremely simple, and depending upon use, the illustrated structure can well achieve the object of the present invention.

It is to be noted that even if the means 10, 11 for dispersing gas as employed in the above-described embodiment is not especially provided, in the event that powder can be supplied to the region where the electrodes exist already in a well dispersed state depending upon characteristics, a feed rate and a flow velocity of the carrier gas, in some cases these powder dispersing means are unnecessary to be especially provided. The embodiment in such cases is also included in the scope of the present invention.

Figure 10:
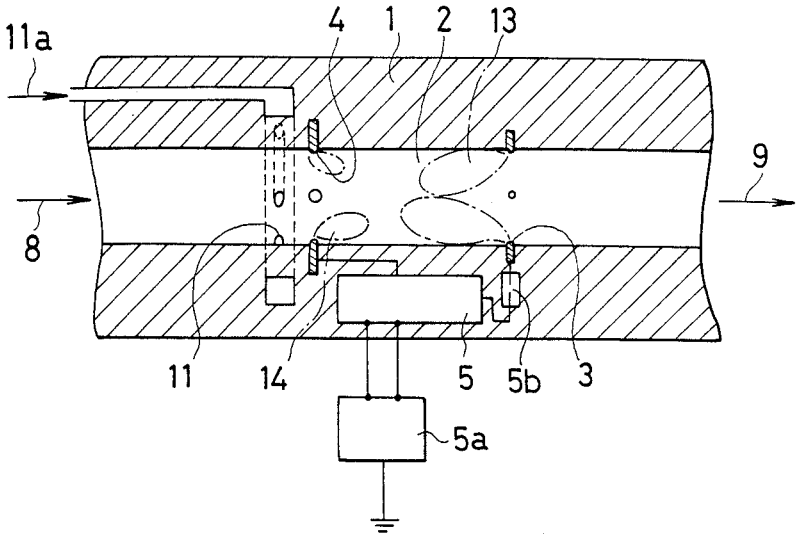

In a yet further preferred embodiment shown in FIG. 10, on the inside of a cylindrical body 1 having a circular cross-section configuration is formed a tubular passage 2 for transporting powder 8 carried by gas, on the inner surface of the tubular passage 2 is disposed a desired polarity plasma electrode 3 having an extremely small radius of curveture at its tip end, an opposite polarity plasma electrode 4 having a large radius of curvature at its tip end is disposed as opposed to the former plasma electrode 3, and a D.C. voltage difference is intermittently applied between these plasma electrode from a D.C. voltage source 5 via a discharge gap **5*b*. In this case, like the other embodiments it is not always necessary to ground one of the electrodes, but the case where a potential difference is maintained between the respective electrodes while applying two different voltages from ungrounded terminals of the voltage source 5** to the respective electrodes just as this embodiment, is also included in the scope of the present invention.

In addition, in this preferred embodiment, a dispersing gas jet port 11 for blowing in a dispersing gas 11*a* in a tangential direction is provided on the inner surface of the tubular passage 2, thereby the gas can be well dispersed under the condition where it has approached to the tube wall, then at first the gas passes through a space 14 where mainly opposite polarity ions exist which space is formed in the proximity of the opposite polarity plasma electrode 4, and thereafter it passes through a space 13 where mainly desired polarity ions exist. However, in this instance there is a large difference in the radius of curvature at the tip end of the corona electrode, hence the space 13 where mainly the desired polarity ions exist is far greater and stronger than the space 14 where mainly the opposite polarity ions exist, and therefore, the powder can be sufficiently charged with the desired polarity as a whole, and is ejected from the apparatus as charged powder 9.

In this embodiment also, like the embodiment shown in FIG. 9, in the event that the powder comes into the tubular passage 2 in a already well dispersed state, in some case the dispersing means 11 and the dispersing gas 11a for the powder are not always necessary, but such case is also included in the scope of the present invention.

Figure 11:
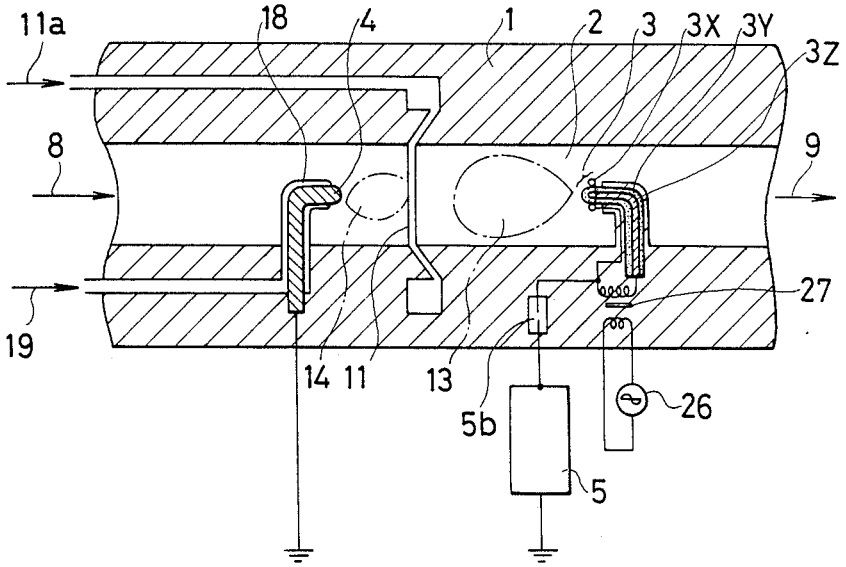

FIG. 11 shows a still further preferred embodiment of the present invention which is especially suitable for practicing a high-efficiency large-capacity powder charging apparatus in that a plasma generating capability of the desired polarity plasma electrode is chosen especially large.

In FIG. 11, on the inside of a cylindrical body 1 made of insulating material and having a circular crosssection configuration is formed a tubular passage 2 for transporting powder 8 carried by gas, and on the axis of that tubular passage 2 is disposed an A.C. drive type plasma generating electrode which operates as a desired polarity plasma electrode 3. In this desired polarity plasma electrode 3, at the center of a thin tubular insulator 3Y made of ceramics or the like is disposed a central electrodes 3Z, on the outside of them is disposed a surface electrode 3X in a head-band shape, between these central electrode 3Z and the surface electrode 3X is applied an A.C. high voltage from an A.C. voltage source 26 via a transformer 27, and furthermore to these electrodes is intermittently applied a D.C. voltage from a D.C. voltage source 5 through a discharge gap 5*b*.

An opposite polarity plasma electrode opposed to these electrodes could be normally a corona discharge electrode 4 having a large radius of curvature at its tip end, and if necessary, arrangement is such that an adhesion prevention gas 19 is ejected from an opposite polarity electrode gas jet port 18 provided around the opposite polarity plasma electrode 4 so that adhesion of powder to the tip end of the electrode 4 may be prevented, and this electrode 4 is grounded.

In addition, the apparatus is constructed in such manner that a dispersing gas 11*a* may be ejected from a ring-shaped dispersing gas jet port 11 opening between the respective electrodes and at this position the carried powder may take a sufficiently dispersed condition. The desired polarity plasma electrode used in this embodiment is favorable for realizing an especially strong and largecapacity powder charging apparatus according to the present invention, because extremely strong A.C. plasma is generated in the proximity of the surface electrode 3X by the A.C. high voltage applied between the surface electrode 3X and the central electrode 3Z and thereby the space 13 where mainly the desired polarity ions exist is strongly formed.

It is to be noted that in the case of the abovedescribed desired polarity plasma electrode 3, since powder particles cannot approach to the proximity of this plasma electrode 3 due to an action of an extremely strong and uneven A.C. electric field formed in the proximity of the surface electrode 3X, in many cases there is no need to employ special adhesion preventing means, but for the purpose of preventing adhesion of powder upon starting and stopping an adhesion preventing gas could be introduced to the proximity of this electrode. In this figure, reference numerals not specifically referred to, are given to items which are common to other figures. In addition, the means for applying an A.C. voltage between the respective plasma exciting electrodes 3X and 3Z should not be limited to the system employing a transformer as illustrated in this embodiment, but a ripple voltage superposed on a D.C. voltage could be utilized by appropriately selecting a number of stages and circuit parameters in a high voltage generator circuit.

Figure 12:
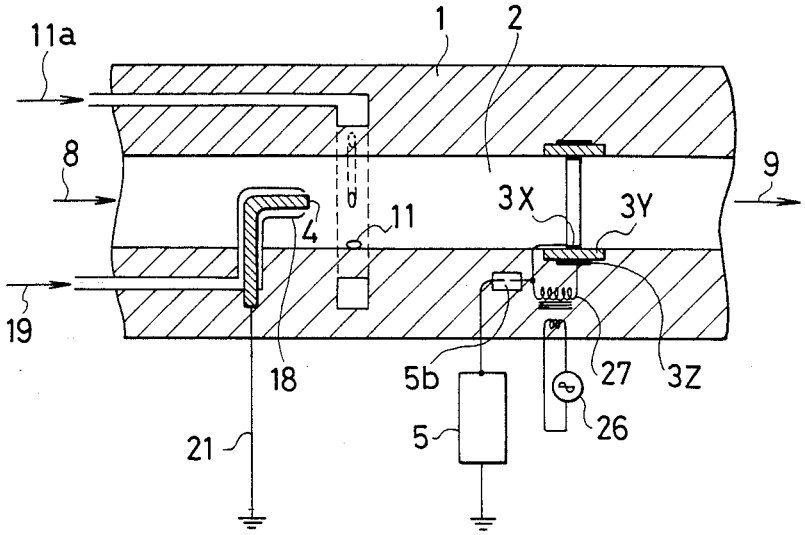

FIG. 12 shows a powder charging apparatus according to the present invention which is characterized in that on the inside of a cylindrical body 1 made of insulating material and having a circular cross-section configuration is formed a tubular passage 2 for transporting powder 8 carried by gas, an A.C. plasma generating electrode for intensely generating desired polarity ions is disposed in a ring shape on the inner surface of the tubular passage 2, and an opposite polarity plasma electrode 4 having a large radius of curvature at its tip end is disposed on the axis of the tubular passage 2 as opposed to the A.C. plasma generating electrode. In FIG. 12, on an inner surface of a ring 3Y normally made of ceramic insulator and provided on the inner surface of the tubular passage 2, is disposed a thin wire-shaped surface electrode 3X, also on the back side of the ring 3Y is disposed a broad planar ring-shaped electrode 3Z, these respective electrodes are supplied with A.C. power by an A.C. voltage 26 so that an A.C. high voltage may be applied between the respective electrodes via a transformer 27, and also a D.C. voltage source 5 for raising the potentials of the respective electrodes applied with the A.C. voltage as a whole is connected to these electrodes through a discharge gap 5*b* for switching on and off the voltage. In addition, the opposite polarity plasma electrode 4 is grounded through a lead wire 21, an adhesion preventing gas 19 is adapted to be ejected through an opposite polarity plasma electrode gas jet port 18 around the electrode 4, also a dispersing gas 11*a* is ejected through a dispersing gas jet port 11 from the middle between the respective electrode and thereby powder can pass through the tubular passage 2 in a well dispersed state as approaching to the inner wall of the tube. In this embodiment, since extremely intense A.C. plasma is formed in the periphery of the electrode 3X by the action of the high A.C. voltage applied between the electrode 3X and the electrode 3Z, an extremely large amount of desired polarity ions would flow without interruption towards the opposite polarity plasma electrode owing to an D.C. electric field established from these electrodes 3X and 3Z towards the opposite polarity plasma electrode 4 by the D.C. voltage source 5. Accordingly, the powder passing through the proximity of these electrodes as well dispersed and close to the tube wall can be ejected as very strongly charged powder 9, according to this system a preferred embodiment of the present invention which is extremely suitable in the event that it is desired to obtain powder having a high charge density in a large amount, can be established.

In the preferred embodiments of the present invention illustrated in FIGS. 1 to 12 and described in detail above, as a desired polarity plasma electrode mainly a corona discharge electrode having a small radius of curvature or an A.C. plasma generating electrode is employed, as an opposite polarity plasma electrode a corona discharge electrode consisting of a needle electrode having a relatively large radius of curvature is employed, and besides, as means for dispersing powder some embodiments employ a choke, some employ a dispersing gas and some employ a turning flow, or else a dispersing plate consisting of a baffle plate could be employed. In addition, as means for bringing powder remote from a space where mainly opposite polarity ions exist, some embodiments employ a space where the gas carrying the powder is not flowing, some employ a conical body, or else a diameter of a tubular passage is varied along the lengthwise direction of the tube, or as shown in FIG. 6 a baffle device is employed. However, it is possible to employ any arbitrary combination of these means so long as it does not depart from the essence of the present invention, and depending upon the objects of utilizations, they could be used as selected from the respective group and as combined together.

In addition, as means for preventing powder from adhering to and accumulating on the respective electrodes, a system in which gas is ejected so as to surround the electrodes, a system employing an A.C.-driven plasma generating electrode as shown in FIGS. 11 and 12 as an electrode, or a system consisting of a combination of the above-mentioned systems, could be utilized as selected according to necessity.

In the following, description will be made on preferred embodiments in which the powder charging apparatus according to the present invention is utilized in an electrostatic powder painting apparatus, and in these preferred embodiments also, as described above, the basic constituent elements of the present invention such as electrodes, means for dispersing powder, means for bringing powder remote from a space where opposite polarity ions mainly exist, and the like could be employed as appropriately selected and combined according to an object of practice.

Figure 13:
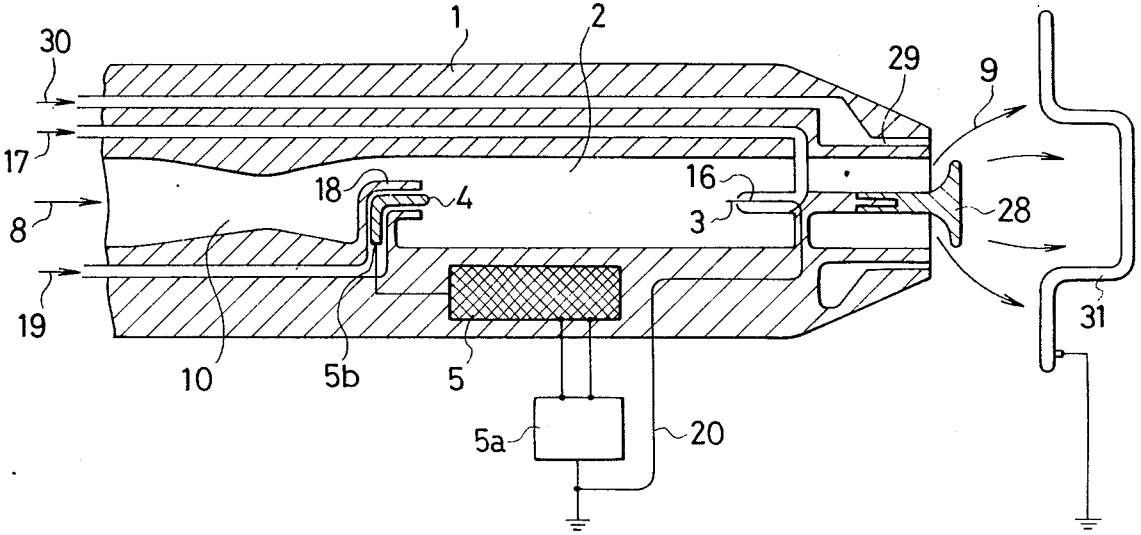
FIGS. 13, 14, 15 and 16, respectively, are longitudinal cross-section views of different preferred embodiments of an electrostatic powder painting apparatus according to the present invention.

FIG. 13 shows one preferred embodiment in which an electrostatic powder painting apparatus having extremely excellent penetrating performance is formed by making use of the above-descried powder charging apparatus according to the present invention. In this embodiment, on the inside of a cylindrical body 1 made of insulating material and having a circular cross-section configuration is formed a tubular passage 2 for transporting powder 8 carried by gas, a desired polarity plasma electrode 3 consisting of a needle electrode having a small radius of curvature at its tip end is disposed in the proximity of a terminal end of the tubular passage 2, while an opposite polarity plasma electrode 4 consisting of a needle-like corona discharge electrode having a large radius of curvature at its tip end is disposed as opposed to the former plasma electrode 3, a high voltage is applied intermittently to the opposite polarity plasma electrode 4 from a D.C. voltage source 5 through a discharge gap 5b, and the above-described desired polarity plasma electrode 3 is grounded through a lead wire 20. Reference numeral **5*a* designates a high frequency voltage source for feeding electric power to the D.C. voltage source. At the upstream of the opposite polarity plasma electrode 4 is disposed, for example, a choke 10, if necessary, for the purpose of well dispersing the powder, thereby the powder passes at first through a space where mainly opposite polarity ions exist in a well dispersed state, thereafter it passes a space where mainly desired polarity ions exist, and it is ejected from the end of the tubular passage 2 as charged powder 9. In that instance, for the purpose of adjusting a pattern of ejection, a dispersing plate 28 is disposed, thereby appropriate divergence is given to the ejecting pattern, and in the case where the divergence caused by the dispersing plate is made small, provision is made such that a pattern adjusting gas indicated by an arrow 30 may be ejected from a pattern adjusting gas jet port 29 to adjust the pattern. In addition, reference numeral 31 designates an article to be painted. In the illustrated embodiment of the present invention constructed in the above-described manner, since the tip end of the electrostatic powder painting apparatus is held in a grounded condition by the lead wire 20, no electric field is formed between the apparatus and the article to be painted, hence when the powder 9 ejected from the tip end of the electrostatic powder painting apparatus is blown to the article to be painted, the socalled Faraday cage effect in which by the action of the electric field directed from the tip end of a gun to an article to be painted, powder is deposited in concentration to the portion subjected to a strong electric field and not deposited to a recessed portion as is the case with the conventional electrostatic powder painting apparatus, would not arise at all, but only in the event that the powder blown to the article to be painted has come close to the article to be painted, the powder is deposited to the article to be painted by a space charge electric field effect generated by electric charge possessed by the powder itself, and therefore, an electrostatic powder painting apparatus having an extremely excellent penetrating performance can be provided. In this connection, in the case where the powder is very strongly charged, and no voltage is applied to the tip end of the gun, sometime it occurs that the powder is dispersed too much by mutual repulsion effects of the electric charge possessed by the powder itself and hence it becomes difficult to be blown into a narrow area, and in such instances, in some cases the lead wire 20 is connected to a terminal having an appropriate magnitude of D.C. potential in the voltage source 5** to form a weak electric field and thereby an electrostatic powder painting apparatus having an appropriate and high efficiency and an excellent penetrating performance is provided. Such embodiments are also included in the scope of the present invention.

In addition, it is quite similar to the previously described embodiments of the powder charging apparatus that in order to prevent the powder from adhering to the tip ends of the electrodes under a transient condition of starting or stopping, adhesion preventing gases 17 and 19 are used.

Figure 14:
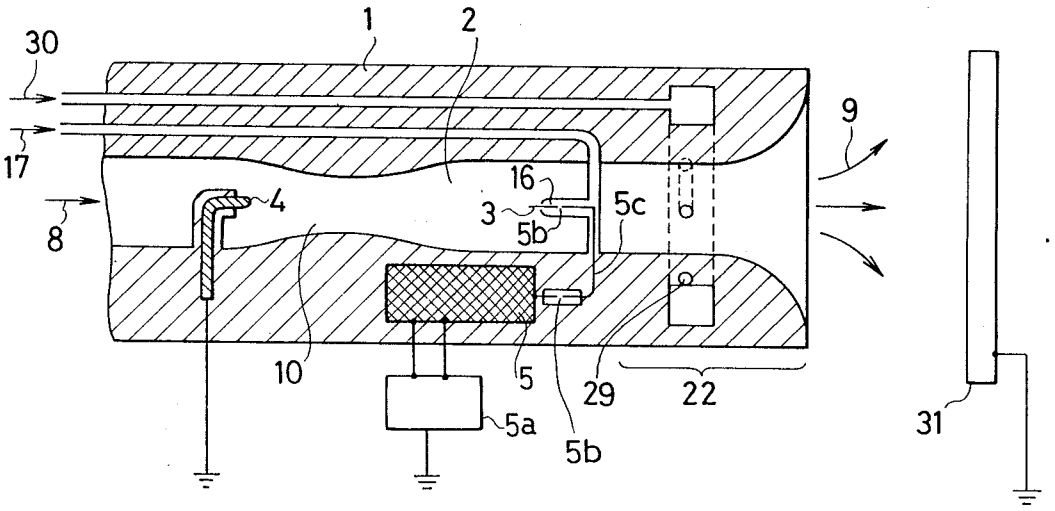

FIG. 14 shows another embodiment for providing an electrostatic powder painting apparatus that is very favorable in the case of practicing a thick-film electrostatic powder painting apparatus by making use of the powder charging apparatus according to the present invention. In this figure, on the inside of a cylindrical body 1 made of insulating material and having a circular cross-section configuration is formed a tubular passage 2 for transporting powder 8 carried by gas, a short tube 22 including an adjusting device 29 for adjusting a powder ejecting pattern is provided on the outlet side of the tubular passage 2 along its axis, a desired polarity plasma electrode 3 consisting of a corona discharge electrode having an extremely small radius of curvature at its tip end is disposed at the upstream of the short tube 22, an opposite polarity plasma electrode 4 having a relatively large radius of curvature at its tip end is disposed as opposed to the former plasma electrode 3 and is grounded, and a D.C. high voltage is intermittently applied to the desired polarity plasma electrode 3 from a D.C. voltage source via a discharge gap 5*b*. It is to be noted that while the discharge gap 5*b* is shown as located in the both end portions of a lead wire 5*c* in the drawings, this indicates merely possible mount positions of the discharge gap 5*b*, and it suffices to provide only in either one end portion. In addition, reference numeral 5*a* designates a high frequency voltage source for feeding electric power to the D.C. high voltage source 5. Furthermore, between the electrode 3 and the electrode 4 is provided means for dispersing powder by making use of a choke 10 which wall already explained in detail above, and for the purpose of adjusting an ejecting pattern of charged powder 9, a flow rate of an ejecting pattern adjusting gas as indicated by an arrow 30 is adjusted. In addition, reference numeral 31 designates an article to be painted, and reference numeral 16 designates a jet port for ejecting an adhesion preventing gas 17 which serves to prevent the powder from adhering to the tip end of the desired polarity plasma electrode. In the electrostatic powder painting apparatus according to the present invention constructed as described above, as already explained in detail, well dispersed powder can be sufficiently charged between the desired polarity plasma electrode and the opposite polarity plasma electrode, and it passes through the short tube 22 and is blown to the article to be painted. In this case, since the desired polarity plasma electrode applied with a high voltage is located in the proximity of the ejecting port, an intense electric field directed towards the article to be painted is formed thereby, hence powder charged by the action of this electric field travels toward the article to be painted and is deposited thereon, but in this instance since an electric current flowing from the desired polarity plasma electrode towards the article to be painted is sufficiently suppressed in substance due to existence of the short tube 22, on the surface of the article to be painted an ionic current flowing from the tip end of the electrostatic powder painting apparatus to the surface of the article to be painted is not present, hence back corona discharge would hardly occur, also since only an electric field exists, a painting efficiency can be held considerably high, and thereby electrostatic powder painting of an extremely thick film without accompanied by back corona discharge, can be practiced.

Figure 15:
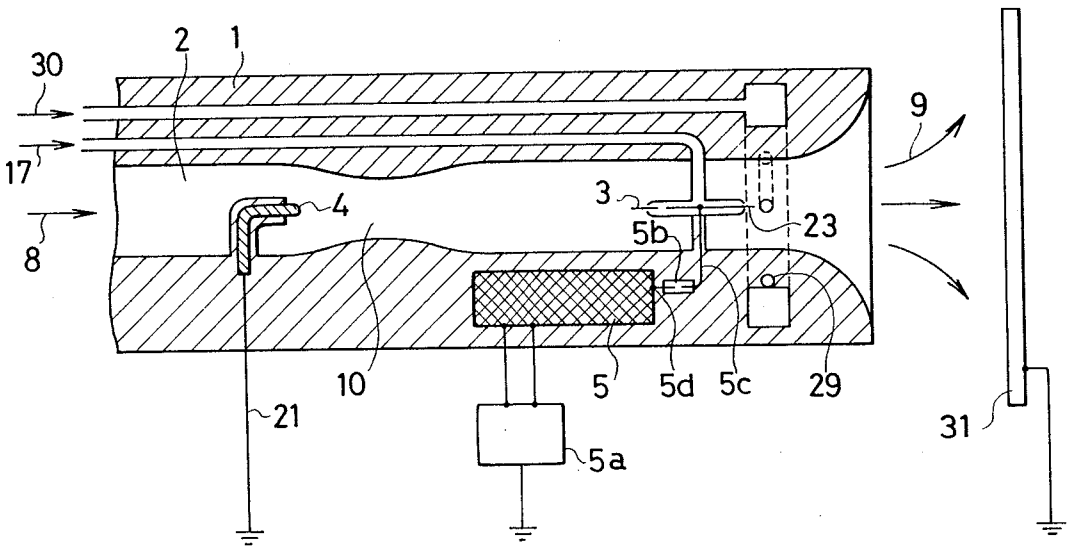

FIG. 15 shows still another embodiment for providing a very high performance electrostatic powder painting apparatus having a very high painting efficiency and an excellent back painting property by making use of the powder charging apparatus according to the present invention. In FIG. 15, on the inside of a cylindrical body made of insulating material and having a circular crosssection configuration is formed a tubular passage 2 for transporting powder 8 carried by gas, a desired polarity plasma electrode 3 is disposed on the axis of the tubular passage 2 on its outlet side, a high voltage is applied intermittently to this plasma electrode 3 by means of a voltage source 5 and a discharge gap 5*b*, and also there is provided an anti-object corona electrode 23 connected to the plasma electrode 3 and directed to the outlet side. In addition, as an opposite polarity plasma electrode 4, a corona discharge electrode having a relatively large radius of curvature at its tip end is disposed as shown in FIG. 15, and this plasma electrode 4 is grounded via a lead wire 21. It is to be noted that while the discharge gap 5b is disposed at two locations in the figure, in practice one of them is omitted. Also, reference numeral 5*a* designates a high frequency voltage source for feeding electric power to the D.C. voltage source 5. In addition, an adhesion preventing gas indicated by an arrow 17 is used for the purpose of preventing the powder from adhering to the tip end of the desired polarity plasma electrode and the tip end of the anti-object corona electrode 23. Also, a pattern adjusting gas indicated by an arrow 30 is ejected in a turning flow from a pattern adjusting gas jet port 29 opening in the proximity of an end of the tubular passage 2 so that an ejecting pattern of the charged powder 9 blown from the electrostatic powder painting apparatus can be adjusted by regulating the flow rate of this gas. According to the illustrated embodiment, owing to the powder charging action according to the present invention which was already explained in detail, powder charged very strongly in the same polarity as the desired polarity plasma electrode in the region between the desired polarity plasma electrode 3 and the opposite polarity plasm electrode 4, is ejected, and furthermore, in addition thereto since the powder is again charged by an intense electric field and a corona discharge current established from the tip end of the anti-object corona electrode 23 towards the object, i.e. the article to be painted, the powder can practice electrostatic powder painting with extremely high painting efficiency and back painting property, owing to a strong electric field directed from the tip end of the electrostatic powder painting apparatus towards the article to be painted as well as a large amount of charge on the powder. It is to be noted that in the electrostatic powder painting system according to the above-described embodiment, the means for practicing the basic elements of the powder charging apparatus according to the present invention as described in detail above can be arbitrarily selected and combined depending upon the purpose, and also with regard to the methods for forming and adjusting the ejecting pattern, besides the illustrated means, every means known in the art can be employed. This is also true with respect to the embodiments shown in FIGS. 13 and 14, respectively.

Figure 16:
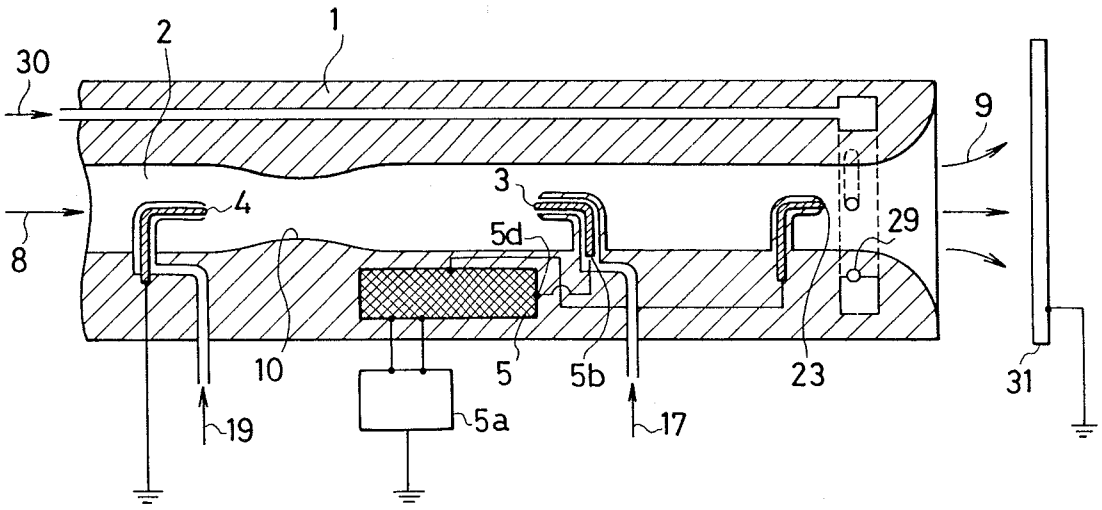

FIG. 16 shows yet another embodiment, in which an electrostatic powder painting apparatus having well matched penetrating performance and painting efficiency can be provided by making use of the powder charging apparatus according to the present invention. In FIG. 16, on the inside of a cylindrical body 1 made of insulating material and having a circular cross-section area, is formed a tubular passage for transporting powder 8 carried by gas, an anti-object corona electrode 23 opposed to an article 31 to be painted is provided on the axis of the tubular passage 2 on the outlet side thereof, a desired polarity plasma electrode 3 is disposed at the upstream of the corona electrode 23 a little apart therefrom, an output terminal 5d at the highest voltage of a D.C. voltage source 5 is connected to the electrode 3 via a discharge gap 5*b*, an intermediate voltage terminal of the D.C. voltage source 5 is connected to the anti-object corona electrode 23, and an opposite polarity plasma electrode disposed at the most upstream position is grounded. In this preferred embodiment, charging of powder is effected in the region between the plasma electrode 4 and the plasma electrode 3 similarly to the previously described embodiments, and an appropriate intermediate voltage value is selected and applied to the electrode 23 so that the electrode 23 may establish such degree of somewhat weak electric field that it may not deteriorate a penetrating performance of the charged powder flow 9 but it may appropriately assist the flying of the powder towards the article to be painted. With the above-mentioned provision, an electrostatic powder painting apparatus having both a penetrating performance and a painting efficiency which are intermediate and well matched with each other, can be provided.

While the desired polarity plasma electrode and the opposite polarity plasma electrode used according to the present invention was explained in connection to a needle electrode and an A.C. driven plasma generating electrode in the above description, if necessary, other types of electrodes which can generate plasma such as a knife-edge electrode, a thin wire electrode, etc. could be employed.

Since the present invention has the above-described features, and since the pair of electrodes used for charging powder are both plasma generating electrodes such as needle electrodes, knife-edge electrodes, wire electrodes, A. C. drive type electrodes, etc., stable operation in powder for a long period of time can be assumed without adhesion and accumulation of powder to and on the respective electrodes, and for the purpose of charging of powder paint, strong long-time stable charging performance can be assured almost independently of material properties of the powder. Especially, according to the present invention, since a D.C. voltage is applied intermittently between the respective electrodes, as compared to the case where the same D.C. voltage is applied continuously, an amount of charge can be increased by 30–100%.

In addition, by combining powder paint that has been internally strongly charged by the powder charging apparatus according to the present invention with an external electric field, an external ionic current and ejection pattern adjusting means, an electrostatic powder painting apparatus having extremely excellent penetrating performance, thick painting performance, painting efficiency and back painting performance, can be newly provided, and all these apparatuses present high performance stability in a long term operation. The external electric field and the external ionic current employed in the above-described electrostatic powder painting apparatus is very important even in the case where the external electric field and the external ionic current are not present at all, and it was considered almost impossible in the prior art to practice such electrostatic powder painting stably and at a high efficiency for a long term independently of material properties of powder paint.

Figure 17:
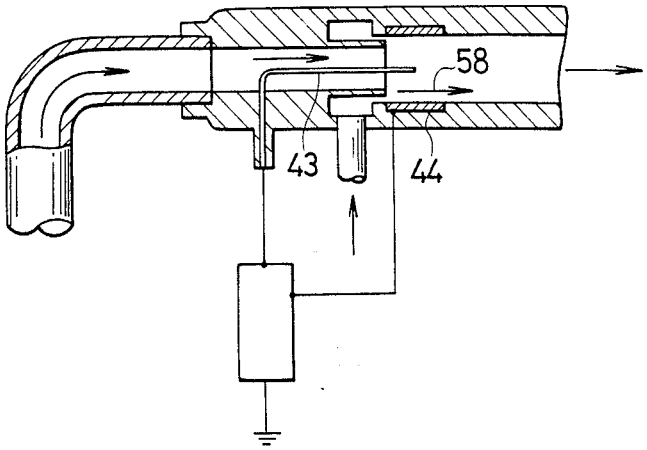
FIG. 17 PRIOR ART
FIGS. 17 and 18, respectively, are longitudinal cross-section views of two different examples of the powder charging apparatuses in the prior art.
Figure 18:
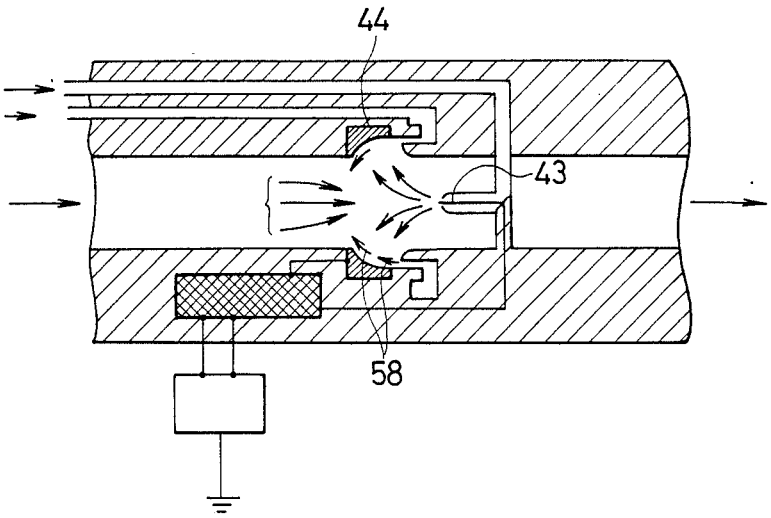
FIG. 18 PRIOR ART

Whereas in the prior art, as shown in FIGS. 17 and 18, one of a pair of electrodes employed for charging powder is a corona discharge electrode 43, while the other is a cylindrical electrodes 44 which can be deemed substantially to be a plane, and under an operating condition, since there exist only a high voltage applied between the respective electrodes and a monopolar desired polarity ionic current flowing unidirectionally, essentially powder is apt to adhere to and accumulate on the surface of the cylindrical electrode 44, and even a little powder, once it has adhered to the electrode 44, it causes generation of back corona discharge, an opposite polarity ionic current flows inversely from this electrode 44 towards the corona discharge electrode 43, resulting in neutralization of the desired polarity ions and electric charge, thereby charging performance of the electrodes would be lowered quickly as the powder adheres and accumulates, and continuous operation for a long term would become difficult. This phenomenon is especially remarkable in the case of charging powder having a low melting point and strong adhesiveness, and it is practically impossible to realize practical stable operation for more than several hours even with counter-measures such as improvements in the material, shape and surface working of the cylindrical electrode 49 and in the flow rate and ejecting velocity of a clear air 58.

What is claimed is:

1. A powder charging apparatus comprising an insulative tubular passage for transporting powder carried by gas, a pair of plasma electrodes provided within said tubular passage, means for intermittently applying a D.C. voltage between said pair of electrodes, a space where mainly desired polarity ions drawn from said electrode pair exist, a space where mainly opposite polarity ions exist, and means for feeding well dispersed powder into that portion of the said space where mainly desired polarity ions exist.

2. A powder charging apparatus as claimed in claim 1, characterized in that a voltage-current characteristic of a desired polarity plasma electrode from which desired polarity ions are drawn is made larger than a voltage-current characteristic of an opposite polarity plasma electrode from which opposite polarity ions are drawn.

3. A powder charging apparatus as claimed in claim 1, characterized in that said apparatus further includes means for keeping powder remote from the space where mainly opposite polarity ions exist.

4. A powder charging apparatus as claimed in claim 1, characterized in that the space where mainly desired polarity ions exist is upstream of the plasma electrode generating said desired polarity ions with respect to the direction of transportation of the powder.

5. A powder charging apparatus as claimed in claim 1, characterized in that the plasma electrodes are provided with means for preventing adhesion of powder thereto.

6. A powder charging apparatus as claimed in claim 1, characterized in that the desired polarity plasma electrode is connected to ground.

7. The powder charging apparatus as claimed in claim 1 characterized, in that the plasma electrode from which desired polarity ions are drawn comprises two closely-spaced electrodes connected to said means for intermittently applying a D.C. voltage.

8. The powder charging apparatus as claimed in claim 7 characterized, in that said means for intermittently applying a D.C. voltage comprises means for intermittently applying a D.C. voltage of different magnitude between each of said closely-spaced electrodes and the other one of said plasma electrodes.

9. The powder charging apparatus as claimed in claim 1 characterized, in that the means for intermittently applying a D.C. voltage between the pair of electrodes includes means for applying an A.C. voltage between the pair of electrodes.

10. A powder charging apparatus comprising an insulative tubular passage for transporting powder carried by gas, a pair of plasma electrodes provided within said tubular passage, means for intermittently applying a D.C. voltage between said pair of electrodes, a space where mainly desired polarity ions drawn from said electrode pair exist, a space where mainly opposite polarity ions exist, and means for feeding well dispersed powder to said space where mainly desired polarity ions exist, said means for intermittently applying a D.C. voltage between the pair of electrodes being a discharge gap provided between the higher voltage side plasma electrode among said pair of plasma electrodes and a D.C. voltage source.

11. A powder charging apparatus as claimed in claim 10, characterized in that the discharge gap provided between the higher voltage side plasma electrode and the D.C. voltage source is formed in the lead wire connecting said higher voltage side plasma electrode to the D.C. voltage source.

12. A powder charging apparatus as claimed in claim 10, characterized in that the discharge gap provided between the higher voltage side plasma electrode and the D.C. voltage source is disposed within a gas jet port of the higher voltage side plasma electrode.

13. A powder charging apparatus as claimed in claim 10, characterized in that the discharge gap provided between the higher voltage side plasma electrode and the D.C. voltage source is formed between the higher voltage plasma electrode and an end portion of a lead wire connected to the D.C. voltage source within a gas jet port of the higher voltage side plasma electrode.

14. A powder charging apparatus as claimed in claim 10, characterized in that a voltage-current characteristic of a desired polarity plasma electrode from which desired polarity ions are drawn is made larger than a voltage-current characteristic of an opposite polarity plasma electrode from which opposite polarity ions are drawn.

15. A powder charging apparatus as claimed in claim 10, characterized in that said apparatus comprises means for keeping powder remote from the space where mainly opposite polarity ions exist.

16. A powder charging apparatus as claimed in claim 10, characterized in that the space where mainly desired polarity ions exist is upstream of the plasma electrode from which said desired polarity ions are drawn with respect to the direction of transportation of the powder.

17. A powder charging apparatus as claimed in claim 10, characterized in that the plasma electrodes are provided with means for preventing adhesion of powder thereto.

18. A powder charging apparatus as claimed in claim 10, characterized in that the plasma electrode from which desired polarity ions are drawn is connected to ground.

19. An electrostatic powder painting apparatus comprising a powder charging apparatus including an insulative tubular passage for transporting powder carried by gas, a plasma electrode pair consisting of a desired polarity plasma electrode and an opposite polarity plasma electrode disposed within said tubular passage, means for intermittently applying a D.C. voltage between said pair of plasma electrodes, a space where mainly desired polarity ions drawn from said electrode pair exist, a space where mainly opposite polarity ions exist, and means for feeding well dispersed powder to the space where mainly desired polarity ions exist.

20. An electrostatic powder painting apparatus as claimed in claim 19, characterized in that the insulative tubular passage for transporting powder carried by gas is provided with a short tube on its outlet side.

21. An electrostatic powder painting apparatus as claimed in claim 19, characterized in that the opposite polarity plasma electrode is connected to ground, the desired polarity plasma electrode is disposed in the proximity of the downstream end of the tubular passage and includes a corona discharge electrode in said tubular passage facing outwardly in the direction of an object to be coated.

22. An electrostatic powder painting apparatus as claimed in claim 20, characterized in that the opposite polarity plasma electrode is connected to ground, the desired polarity plasma electrode is disposed in the proximity of the downstream end of the tubular passage and includes a corona discharge electrode in said tubular passage facing outwardly in the direction of an object to be coated.

23. The electrostatic powder painting apparatus as claimed in claim 22, characterized in that the magnitude of D.C. voltage between said pair of plasma electrodes is intermediate the magnitude of the D.C. voltage applied between said corona discharge electrode and ground.

24. An electrostatic powder painting apparatus as claimed in claim 19, characterized in that said desired polarity plasma electrode is connected to ground.

25. The electrostatic powder painting apparatus as claimed in claim 24, characterized in that said desired polarity plasma electrode is disposed in the proximity of the downstream end of the tubular passage and that said tubular passage is provided with a powder dispersing plate downstream of said desired polarity plasma electrode.

26. the electrostatic powder painting apparatus as claimed in claim 19, characterized in that the means for intermittently applying a D.C. voltage between the pair of electrodes includes means for applying an A.C. voltage between the pair of electrodes.

27. The electrostatic powder painting apparatus as claimed in claim 21, characterized in that the magnitude of D.C. voltage between said pair of plasma electrodes is intermediate the magnitude of the D.C. voltage applied between said corona discharge electrode and ground.

28. An electrostatic powder painting apparatus as claimed in claim 20, characterized in that said short tube includes a pattern adjusting gas port.

29. A powder charging apparatus comprising an insulative tubular passage for transporting powder, a pair of plasma electrodes provided within said tubular passage from which desired polarity ions and opposite polarity ions are drawn and means for intermittently applying a D.C. voltage between said pair of electrodes.

30. A powder charging apparatus as claimed in claim 29, characterized in that the means for intermittently applying a D.C. voltage between the pair of electrodes applies the D.C. voltage at a repetition rate of 5,000–50,000 cycles per second.

31. The powder charging apparatus as claimed in claim 29, characterized in that the means for intermittently applying a D.C. voltage between said pair of electrodes is a discharge gap provided between the higher voltage plasma electrode among said pair of plasma electrodes and a D.C. voltage source.

32. The powder charging apparatus as claimed in claim 31, characterized in that said discharge gap is 1–5 mm.

33. The powder charging apparatus as claimed in claim 29, characterized in that said means for intermittently applying a D.C. voltage between said pair of electrodes includes means for applying an A.C. voltage between said pair of electrodes.

34. The powder charging apparatus as claimed in claim 29, characterized in that the voltage-current characteristic of the one of said pair of electrodes from which desired polarity ions are drawn is larger than the voltage-current characteristic of the one of said pair of electrodes from which opposite polarity ions are drawn.

35. A powder charging method including the steps of providing a pair of plasma generating electrodes disposed on an axis within an insulative tubular passage, intermittently applying a D.C. voltage between said pair of electrodes to generate a plasma in said insulative tubular passage in the direction of said axis and transporting powder in said tubular passage in the direction of said axis.

36. The method in claim 35 including applying an A.C. voltage between said pair of electrodes.

37. A powder charging method including the steps of providing a pair of plasma generating electrodes disposed within an insulative tubular passage, intermittently applying a D.C. voltage between said pair of electrodes to generate a plasma in said insulative tubular passage, transporting powder in said tubular passage and generating plasma in a manner that provides a space where mainly desired polarity ions exist and a space where mainly opposite polarity ions exist.

38. The method in claim 37 including transporting powder finely dispersed in a gas in said space where mainly desired polarity ions exist.

39. The method in claim 38 including keeping powder remote from said space where mainly opposite polarity ions exist.

* * * * *

UNITED STATES PATENT AND TRADEMARK OFFICE

CERTIFICATE OF CORRECTION

PATENT NO. : 4,805,069

DATED : February 14, 1989

INVENTOR(S) : Hideo Nagasaka et al

It is certified that error appears in the above-identified patent and that said Letters Patent is hereby corrected as shown below:

Column 1, Line 16;

"th e" should be --the-- ;

Column 1, Line 31;

"highvelocity," should be --high velocity,--;

Column 1, Line 35;

After "shaped" delete "shaped" (second occurrence);

Column 1, Line 58;

"hense" should be --hence--;

Column 3, Line 28;

"its is" should be -- it is --.

Column 5, Line 13;

"surface" should be --source--;

Column 5, Line 26;

"chock" should be --choke--;

Column 6, Line 38;

"toward" should be --towards--;

UNITED STATES PATENT AND TRADEMARK OFFICE

CERTIFICATE OF CORRECTION

PATENT NO. : 4,805,069

DATED : February 14, 1989

INVENTOR(S) : Hideo Nagasaka et al

It is certified that error appears in the above-identified patent and that said Letters Patent is hereby corrected as shown below:

Column 6, Line 56;

"chock" should be --choke--;

Column 7, Lines 5 and 6;

"produces" should be --products--;

Column 8, Line 35;

"convature" should be --curvature--;

Column 9, Line 51;

"chose" should be --chosen--;

Column 10, Line 57;

"curveture" should be --curvature--;

Column 12, Line 64;

"an" should be --a--;

Column 13, Line 53;

"above-descried" should be --above-described--;

Column 15, Line 25;

"wall" should be --was--;

UNITED STATES PATENT AND TRADEMARK OFFICE

CERTIFICATE OF CORRECTION

PATENT NO. : 4,805,069

DATED : February 14, 1989

INVENTOR(S) : Hideo Nagasaka et al

It is certified that error appears in the above-identified patent and that said Letters Patent is hereby corrected as shown below:

Column 17, Line 64;

"electrodes" should be --electrode--;

Column 18, Line 21;

"clear" should be --clean--;

Column 18, Claim 1, Line 31;

After "of" delete "the".

Signed and Sealed this

Second Day of January, 1990

*Attest:*

*Attesting Officer*

JEFFREY M. SAMUELS

*Acting Commissioner of Patents and Trademarks*